United States Patent [19]

Dassler et al.

[11] 4,372,462

[45] Feb. 8, 1983

[54] RETAINED RING TAB

[75] Inventors: Karl O. Dassler, Algonquin; Neal E. Langseder, Rolling Meadows, both of Ill.

[73] Assignee: American Can Company, Greenwich, Conn.

[21] Appl. No.: 262,926

[22] Filed: May 12, 1981

[51] Int. Cl.[3] ..... B65D 17/34

[52] U.S. Cl. ..... 220/269

[58] Field of Search ..... 220/265-273

[56] References Cited

U.S. PATENT DOCUMENTS 4,084,721 4/1978 Perry ..... 220/269

*Primary Examiner*—George T. Hall

*Attorney, Agent, or Firm*—Paul R. Audet; William C. Hosford; Aaron Passman

[57] ABSTRACT

A retained ring type lever tab for easy open containers. The tab is provided with two dog leg levers which join at the forward end to form a triangular nose. These levers which in cross section are made up of a pair of parallel flanges 0.050" in width connected by an outer curl of radius 0.030" are particularly effective in transferring the opening force to the displaceable panel in the end. The tab is characterized by a low weight and a high mechanical advantage.

8 Claims, 6 Drawing Figures

RETAINED RING TAB

BACKGROUND OF THE INVENTION

Billions of cans are produced annually for the packaging of beer, soda and other beverages. Despite the fact that these containers are used once and then discarded, they are produced with a high level of precision. These manufacturing procedures and tolerances are prompted by the need to achieve a high utilization of material since even minor savings on materials can be substantial when accumulated for such high levels of production.

One of the major features on the present day beverage container is the retained tab for the easy open end. This tab is designed to remain attached to the end, even despite repeated attempts to remove it from the opened container. The most common retained tab today is the lever tab where the tab, which is riveted to the end panel, extends over a scoreline so that the nose of the tab rests on the displaceable pour panel of the end. By grasping the rear or lift of the tab, it is possible to pivot the tab about the nose so that the tab acting as a second class lever pulls up and pops the scoreline thereby initiating rupture of the score just forward of the rivet. After initial rupture, the lever fulcrum shifts from the tab nose to the edge of the pour hole and the tab acting now as a first class lever causes the encircling scoreline to tear and the pour panel to be displaced inwardly as the tab nose swings downwardly into the container.

Considerable force must be exerted on the tab to effect full opening of the container, and accordingly the tab must be made sufficiently strong to resist failure prior to or during the opening process. Failure of the tab can occur by buckling of the tab along the line of maximum bending moment, just forward of the rivet; by tear through of the tongue, wherein the tongue lance tears on into the tab nose, or by collapse of the nose structure.

Tabs are strengthened by a high level of configuration such as ribbing etc and by the use of multiple layers of metal or metals. Reduced to its elemental form, the tab is merely a lever for which the designer expends materials. The material efficiency of the lever can be assessed by comparing the mechanical advantage of the tab with the weight of material employed in the fabrication of the tab.

Accordingly, it is the primary object of the instant invention to provide a lever tab structure for an easy open end which is sufficiently strong to operate effectively, but which exhibits a high material efficiency.

It is further an object of the instant invention to provide a lever tab structure which is simple to manufacture.

Finally, it is an object of the instant invention to provide a lever tab which is manufactured from a material which is compatible with the can end closure thereby facilitating material recovery.

SUMMARY OF THE INVENTION

It may be seen that the aforementioned objects of the invention may be attained in an easy open end closure which comprises; a control panel wall with a peripheral flange which is joined to the container and wherein the closure further includes an integral rivet and a displaceable panel located outwardly of the rivet and which is substantially defined by a scoreline. In addition, the closure includes a nondetachable lever tab for opening the end which is joined to the central panel by means of the rivet. The lever tab is comprised of a pair of dog leg levers which are arranged symmetrically about the longitudinal axis of the tab. The levers which include a short forward leg and a long lateral leg are joined at the forward end to form the tab nose. The levers comprise an upper planar flange and a lower planar flanged joined by an outer curl. The planar flanges are parallel to one another. At the junction of the forward legs, a cleft is formed in the outer curl to form the tip of the nose. A tongue is attached to the upper flange at the nose of the tab extending rearward therefrom and including an aperture to receive the staking rivet. A lift member which forms the rear of the tab extends transversely to the longitudinal axis to join the lateral legs. The tab lift may be raised to cause the tab nose to bear against said displaceable panel and enter said container.

It is preferable that the upper and lower flanges have a width of 0.050" and that the radius of curvature of the outer curl be 0.030".

It is further preferable that the upper flanges be joined by a web and that the forward portion of the web be paneled to form a deboss with steeply ascending walls which buttress and support the upper flange. The deboss is lanced to form the tongue. The rearward portion of the web is preferably apertured to provide a finger hole. The lower rear flange is preferably flattened against the upper rear flange to provide finger access in cooperation with the finger hole.

It is further preferable that the forward legs be joined to form a triangular nose with an included angle of 150° therebetween and that the lateral legs join the forward legs to form an included angle of 108°, the lateral legs being inclined at an angle of 3° to the longitudinal axis. It is additionally preferable that the ascending wall of the deboss panel be inclined at an angle of 60° to the deboss panel.

Finally it is preferable that the tab be formed from 5082 aluminum alloy stock with a temper of H251 and a stock thickness of 0.018".

DETAILED DESCRIPTION OF THE ILLUSTRATED EMBODIMENT

Figure 1:
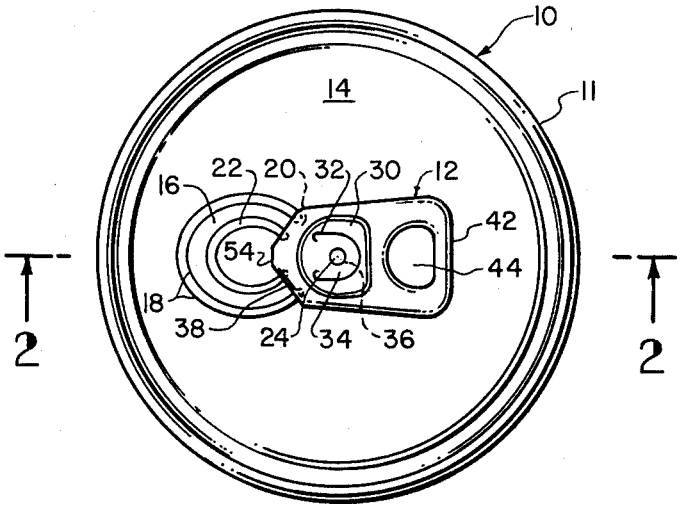
FIG. 1 is a plan view of an end closure embodying the present invention.
Figure 2:
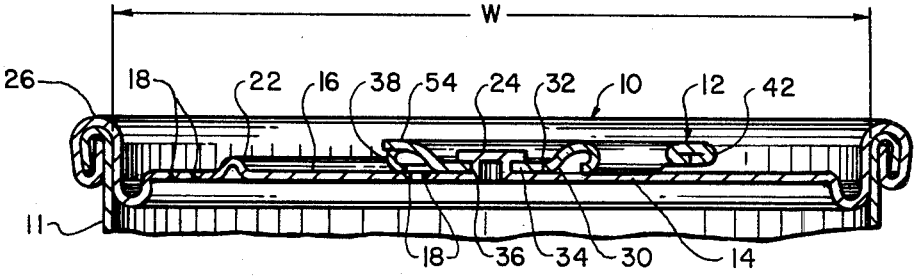
FIG. 2 is an enlarged fragmentary sectional view taken along the Line 2—2 of FIG. 1.

Turning now in detail to FIGS. 1 and 2 of the appended drawings, therein illustrated is an easy open end closure 10 joined to a can body 11 which has been necked in to an opening of reduced diameter w=2-6/16 inches. The closure includes a central panel wall 14 with a displaceable pour panel 16 and a lever tab 12 with a high material efficiency embodying the present invention. The displaceable panel 16 is substantially defined by a continuous scoreline 18 with an unscored portion 20 lying between the extremities of the scoring. The unscored portion or neck serves as a hinge for the displaceable panel allowing it to be displaced into the container and still remain attached to the panel wall, even after opening.

The displaceable pour panel is additionally provided with an up bead 22 which provides structural reinforcement for the panel. The lever tab 12 is an ecologically efficient opening device and is provided with an aperture 36 to receive the staking rivet 24 which is an integral part of the panel wall. The end closure is joined to the container wall 11 as shown in FIG. 2 by means of peripheral flange 26 which is folded over the rim 28 of the can body to form a double seam in accordance with conventional practice. Other suitable joining means may be employed with the instant invention.

Figure 3:
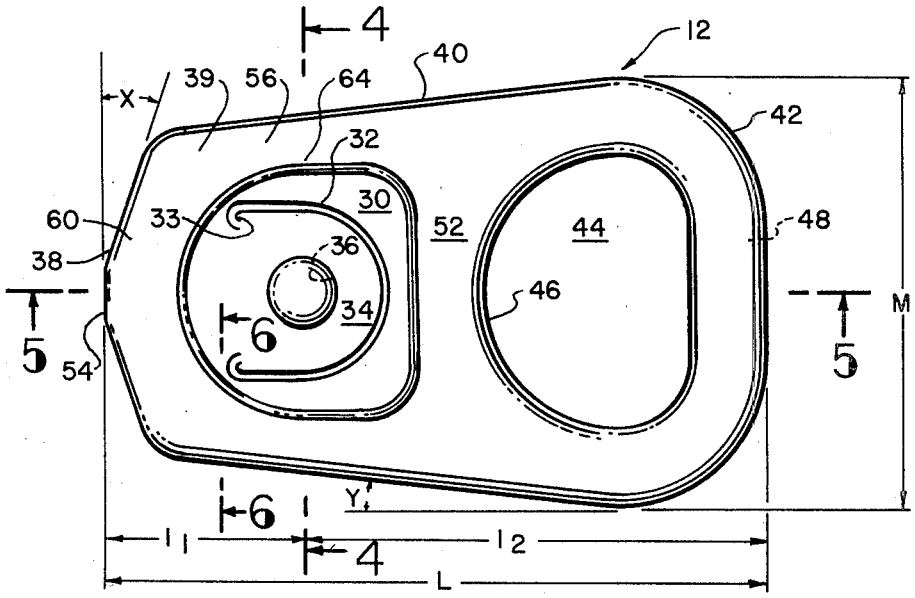
FIG. 3 is an enlarged view of the tab.
Figure 4:
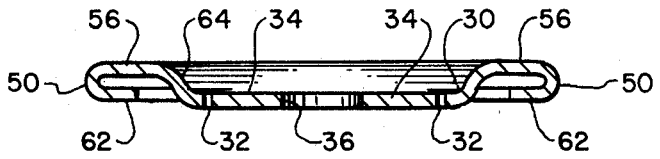
FIG. 4 is an enlarged sectional view of the tab taken along Line 4—4 of FIG. 3.
Figure 5:
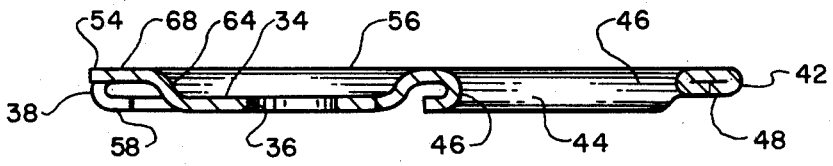
FIG. 5 is an enlarged sectional view of the tab taken along the longitudinal axis of the tab Line 5—5 of FIG. 3.

The opening device 12 as best seen in FIG. 3 is a lever tab symmetrical about a longitudinal axis 5—5. The tab is preferably manufactured of 0.018" thick 5082 aluminum with a H251 temper. The edges of the tab are curled except at the nose tip 54 where the curl is clefted to afford an attaching means to facilitate tab manufacture. The upper face of the tab is a web 52 which is apertured at the rear to provide a finger hole 44 and paneled at the front to form a deboss 30. The deboss 30 is lanced with a U-shaped cut 32 to provide a tongue 34. The terminal ends of the lancing are recurved. Other termination means, such as nail piercing, may be employed. The tongue 34 is apertured to receive the staking rivet 24 which is integral with the end panel.

The inner edge of the finger hole 44 is formed into a curl 46. At the lift member 42, the inner curl and the outer curl are compressed against the upper flange to form a flattened curl 48 which provides finger access in cooperation with finger hole 44.

Figure 6:
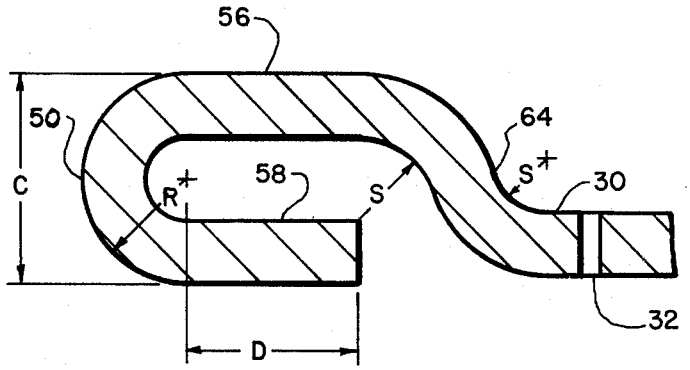
FIG. 6 is an enlarged partial section taken through the lateral lever arm along the Line 6—6 of FIG. 3 coincident with the plane of maximum bending moment.

The primary elements of this tab are the two dog legged levers 39, each with a short forward leg 38 and a relatively long lateral leg 40. In cross section, these levers comprise a pair of parallel planar flanges joined by an outer curl 50 of radius R=0.030". The lower flange 58 has a flat planar surface with a uniform width D=0.050". While the upper flange 56 may vary in width, it is critical that the upper flange width be maintained at a minimum width of 0.050" throughout the short forward leg and in the region of maximum bending moment of the lateral legs immediately forward of the rivet hole (as along line 6—6). Rearward of the rivet hole, the upper flange width may, if necessary, be reduced to accommodate the deboss panel 30, but it is preferable to maintain a flange width of 0.050". The deboss panel has a steep ascending wall 64 with an angle of inclination of about 60° to the panel wall 30. The radius of curvature where the ascending wall 64 joins the panel wall 30 and where the ascending wall 64 joins the upper flange 56 (FIG. 6) is S=0.015". This steep ascending wall buttresses the upper flange throughout the critical area of the tab to prevent buckling. The tab is 1.040" in length with a forward portion $l_1$=0.312" and a rearward portion $l_2$=0.728". The tab has a width at the lift end of M=0.640. The lateral legs of the tab are shown in FIG. 3 to be inclined at an angle Y=3° to the longitudinal axis.

This inclination angle is critical in that a sharper angle of inclination say 4° would reduce the upper flange width in the critical region of the tab.

The two forward legs of the lever combine to serve as the nose of the tab. These short forward legs are inclined at an angle X=about 15° to produce an included angle between the two short legs of about 150°. The outer curl 50 and the lower flange 58 have been eliminated at the tip of the tab nose 54 to expose the raw edge. This raw edge serves to tie the tab to tab strip during manufacture and will be subsequently covered in detail. The tab nose bears against the upper surface of the pour panel with the point of contact serving as the lever fulcrum during the initial or "pop" phase of the opening. During the subsequent or "tear" phase, when the pour panel is torn along the scoreline in the central panel, the fulcrum shifts rearward just forward of the rivet and the lever function as a typical first class lever with the tab nose pushing down on pour panel 16 to displace it into the container. The tab nose must be sufficiently strong to resist collapse and must be configured to prevent tear through either of which would make the tab inoperable.

Typically, the nose of a lever tab consists of three folds of metal to form a laminate inter leafed structure. In some instances, the tab nose is of a composite structure utilizing two different materials. In contrast, the instant tab nose may be seen to be a simpler configuration.

Additionally, the tab nose must be configured to enter the pour hole thereby ensuring full displacement of the pour panel.

In the instant structure the deboss panel 30 with the steeply ascending wall 64 serves first to buttress the nose against collapse, and secondly it serves to redirect tearing force out of the plane of the tongue thereby cooperating with the recurves 33 of the tongue lance 32 to prevent tear through, and tab failure.

In the manufacture of the tab, the small tab size permits a double file of tabs to be produced from a single strip. While alternative processes are possible, the following process is preferred for the manufacture of the tab.

First Station

A pilot hole and the finger hole of the tab are punched. The pilot hole serves to guide the strip stock. The finger hole which is non-circular is utilized in subsequent stations to provide positive orientation of the tab with respect to the tooling. The tie which is used to connect the tip 54 of the tab nose to the tab strip is slit in this first station.

Second Station

The tongue lance 32 is cut.

Third Station

The tab body is blanked thereby separating the tab body from the strip except for the tie at the tip of the nose. The peripheral edges of the tab and the finger hole are wiped up. The tab is also paneled in this station to form the deboss. The paneling with its sharp radii and steeply ascending wall pulls metal away from the tongue lances thereby providing clearance between the tongue and the panel wall. This clearance avoids "clickers" or interferring engagement between the opposite edges of the lance when the tab is employed as an opening lever.

Fourth Station

The turned up edges are curled.

Fifth Station

The curling is completed and the flanges are set.

Sixth Station

The curl 48 at the lift of the tab is flattened to provide a structure which will cooperate with the finger hole by ensuring finger access ability.

Seventh Station

A 0.150" diameter rivet hole is pierced in the tab.

TABLE I

| TAB | WT (Grams) | Mech. Advan. (Pop) | A Matl. Eff. (Pop) | Mech. Advan. (Tear) | B Matl. Eff. (Tear) |
|---|---|---|---|---|---|
| Instant | .50 | 3.33 | 6.66 | 2.33 | 4.67 |
| F | .58 | 3.69 | 6.36 | 2.69 | 4.63 |
| G | .53 | 3.18 | 6.00 | 2.18 | 4.11 |
| E | .53 | 2.96 | 5.58 | 1.96 | 3.69 |
| D | .54 | 2.96 | 5.48 | 1.96 | 3.63 |
| C | .69 | 3.38 | 4.89 | 2.37 | 3.43 |
| B | .70 | 3.38 | 4.82 | 2.37 | 3.39 |
| H | .63 | 2.97 | 4.71 | 1.97 | 3.12 |
| A | .78 | 3.38 | 4.33 | 2.37 | 3.04 |

In Table I, the material efficiency of this tab is compared with other lever tabs. In this evaluation, the tab was examined under two different circumstances.

In Column A, the tab is evaluated as a second class lever. Here the length of the tab is divided by the tab length from the nose tip to the rivet to establish the mechanical advantage for scoreline pop. This mechanical advantage is divided by the tab weight to obtain the Material Efficiency of the tab for Pop.

In Column B, the material efficiency is tabulated for scoreline tear. The mechanical advantage of the tab as a first class lever for tear is determined by dividing the length of the tab from rivet to lift by the tab length from nose tip to rivet. The Material Efficiency of the tab under tear is obtained by dividing the mechanical advantage by the tab weight.

Thus it may be seen that the novel design disclosed by the applicant provides a tab structure which is strong but effective as a lever with a high material efficiency. It may further be seen that the tab is simple to manufacture and that it is compatible with the closure and thereby facilitates material recovery.

What is claimed is:

1. An easy open closure for can bodies comprising:

(a) central panel wall including a peripheral flange for joining said container and an integral rivet centrally disposed in said wall;

(b) a displaceable panel in said central panel wall disposed outwardly of said rivet, of generally circular configuration substantially defined by scoring with the extremities of said scoring separated by an unscored neck to form a hinged attachment for said displaceable panel, and wherein (c) a non-detachable tab with a longitudinal axis comprising:

(i) a pair of dog leg levers disposed symmetrically about said axis, each lever including an upper planar flange and a lower planar flange, said flanges being parallel to one another, and joined by an outer curl, and wherein said levers are formed with a short forward leg and a long lateral leg and wherein said forward legs are joined together to form a tab nose and wherein a raw edge remains in said nose to form a tip of said nose disposed in the plane of said upper planar flange;

(ii) a tongue extending from said upper flange at said nose and rearward therefrom into a debossed plane set at the level of said lower planar flange, said tongue defined by a lanced periphery and being apertured and staked to said central panel by said rivet to hold said tab nose against said displaceable panel, and (iii) a lift member disposed rearward of said tab nose and transversely to said longitudinal axis, the extremities of said lift member joining said lateral legs whereby said tab may be raised to cause said staked connection to flex along said score as said lower flange about said nose tip edge as bears against said displaceable panel to rupture said scoring bending same about said hinged attachment, and (iv) the distance from said staked attachment to said lower flange about said nose tip edge being less than half as far as the distance from said staked attachment to said lift.

2. A closure as recited in claim 1 wherein said distance from said staked attachment to said nose is about 0.312" and said distance from said staked attachment to said lift is about 0.728".

3. A closure as recited in claim 1 wherein said edge is about 0.060" above said debossed tongue.

4. A closure as recited in claim 1 wherein said outer curl has a radius of 0.030" and wherein said flanges are 0.050" in width.

5. A closure as recited in claim 4 wherein said upper flanges are joined by a web and wherein the forward portion of said web is paneled to form a deboss with steeply ascending walls which buttress said upper flange against collapse, said deboss being lanced to form said tongue and wherein said rearward portion of said web is apertured to provide a finger hole.

6. A closure as recited in claim 5 wherein said lift is formed with an upper flange and a lower flange and wherein said curl is flattened to provide finger access.

7. A lever tab for easy open ends comprising:

(a) a pair of dog leg levers disposed symmetrically about a longitudinal axis, each lever including an upper planar flange and a lower planar flange said planar flanges being parallel one to the other and at least 0.050" in width and wherein said flanges are joined by a curl with a radius of 0.030" and wherein said levers are formed with a short forward leg and a long lateral leg with said forward legs joined together to form the nose of said tab with an included angle therebetween of 150° and wherein said lateral legs are inclined at an angle of 3° to said longitudinal axis with the included angle between said forward leg and said lateral leg of 108°, (b) a raw edge at said nose and being in the plane of said upper planar flange in the area where said forward legs joined together and said nose including portions about said raw edge in the plane of said lower planar flange for contact with an end;

(c) a web joining said levers, the forward portion of said web being recessed to form a deboss panel with ascending walls inclined at an angle of about 60° to said deboss panel, said ascending walls joining said upper flange with said deboss panel to strengthen and buttress said upper flange against collapse and wherein said deboss panel is lanced to form a tongue for attachment in the plane of said lower planar flange to hold the portions of said nose against an end and wherein the rear portion of said web is apertured to provide a finger hole;

(d) a tab lift disposed rearward of said tab nose and transversely to said longitudinal axis, the extremities of said lift joining said lateral legs to form a pentagonal tab with a narrow nose and wide lift; and (e) said tongue attachment being less than half as far as from said lower flange portions about said edge than said lift.

8. The tab of claim 7 wherein said tab is manufactured of 5082 aluminum alloy H251 temper stock with a thickness of 0.018".

* * * * *